US005801722A

United States Patent [19]

Ueda et al.

[11] Patent Number: 5,801,722

[45] Date of Patent: Sep. 1, 1998

[54] IMAGE PRINTING DEVICE

[75] Inventors: Masashi Ueda; Ryohei Komiya, both of Nagoya, Japan

[73] Assignee: Brother Kogyo Kabushiki Kaisha, Nagoya, Japan

[21] Appl. No.: 722,568

[22] Filed: Sep. 27, 1996

[30] Foreign Application Priority Data

Sep. 27, 1995 [JP] Japan ..... 7-249157

[51] Int. Cl.[6] ..... B41J 29/38

[52] U.S. Cl. ..... 347/16; 347/14

[58] Field of Search ..... 347/14, 16, 101, 347/105, 106, 19; 395/109

[56] References Cited

U.S. PATENT DOCUMENTS 4,617,580 10/1986 Miyakawa ..... 347/16

*Primary Examiner*—N. Le
*Assistant Examiner*—Thinh Nguyen
*Attorney, Agent, or Firm*—Oliff & Berridge, PLC

[57] ABSTRACT

The print head 7 is designed to eject ink onto a recording head with a plurality of resolution degrees. A plurality of kinds of recording papers have different degrees of ink permeability. Accordingly, ink dots of different diameters can be printed on different kinds of papers. There is a possibility that the characteristic of the recording medium will not properly correspond to the resolution with which the print head 7 is controlled to print images on the recording head. In this case, the printed images will have a low quality. Accordingly, it is necessary to perform a trial printing many times. In order to save time and ink, a characteristic of the recording paper is judged, and the resolution, at which the print head 7 is to be controlled to print images on the recording paper, is selected dependent on the judged result. The printer 1 can therefore reproduce a high quality image and is good in its economical view. The CPU 11 receives image data from the external CPU 50. The resolution data memory 12*a* stores a resolution value which corresponds to a characteristic data obtained by the paper characteristic detector 16. The control signal conversion portion 20 converts the image data into a control signal for controlling the print head 7 to print the image data onto the recording medium at the resolution stored in the memory 12*a*.

15 Claims, 7 Drawing Sheets

T (14a)

| LIGHT AMOUNT VALUE | RESOLUTION |
|---|---|
| 0 | 300 |
| 1 | 300 |
| 2 | 300 |
| 3 | 300 |
| ⋮ | ⋮ |
| 252 | 600 |
| 253 | 600 |
| 254 | 600 |
| 255 | 600 |

IMAGE PRINTING DEVICE

BACKGROUND OF THE INVENTION

1. Field of the Invention

The present invention relates to an image printing device such as an ink jet printer, and more particularly to the image printing device which can print images at various resolutions.

2. Description of the Related Art

There has been conventionally proposed a type of printer which can print images at various resolutions based on a single set of image data. When the printer employs an ink jet print head, control is performed to adjust a dot interval, at which ink dots are to be arranged on a surface of a recording medium such as a recording paper. A diameter of the ink dots is also adjusted.

SUMMARY OF THE INVENTION

FIG. 1(*a*) shows how ink dots are arranged on the recording medium surface to reproduce an image at a resolution of 300 dpi. The ink dots are arranged with an interval of about 85 μm both in the horizontal and vertical directions as viewed in FIG. 1(*a*). The ink dots have a diameter 100*a* of about 120 μm. FIG. 1(*b*) shows how ink dots are arranged on the recording medium surface to reproduce an image at a resolution of 600 dpi. The ink dots are arranged with an interval of about 42 μm both in the horizontal and vertical directions as viewed in FIG. 1(*b*). The ink dots have a diameter 100*b* of about 60 μm.

It is conceivable that the dot interval be adjusted by controlling the scanning speed of the print head in a main scanning direction and by controlling the feeding speed of the sheet in an auxiliary scanning direction. The dot diameter is controlled through adjusting the amount of ink ejected from the print head.

In this case, however, the print head needs to have a complicated structure to adjust the ink ejection amount. The print head has to be controlled through a complicated control operation. The print head will therefore become expensive and large in size.

In order to solve this problem, the following method can be employed.

FIGS. 2(*a*) and 2(*b*) show how an ink droplet 100 ejected from a print head is provided on a surface of a recording paper 102 and how the ink permeates through the paper 102. The manner how the ink permeates through the paper 102 depends on a quality or a characteristic of the paper 102. If the paper 102 has a good ink-permeability, the ink 100 will permeate deeply as shown in FIG. 2(*b*). Accordingly, the ink 100 will spread very little on the sheet surface. The dot diameter 100*b* will therefore become small. Contrarily, if the paper 102 has a degraded ink-permeability, the ink 100 will permeate shallowly as shown in FIG. 2(*a*). The ink 100 will therefore spread widely on the sheet surface. The dot diameter 100*a* will become large.

In view of this, it can be conceived that the dot diameter be adjusted by selecting, from a plurality of kinds of papers, one kind of recording paper 102 that has an ink permeating characteristic which can provide a desired ink diameter. In more concrete terms, the ink jet printer is originally designed to eject small-diameter ink dots onto one kind of paper which has a high ink permeability. In other words, the printer is originally designed to reproduce images at a high resolution onto the paper which has a high ink permeability. In order to reproduce images at a lower resolution, the printer is set with another kind of paper which has a lower ink permeability. The printer will therefore produce a larger-diameter ink dots onto the paper, thereby providing an image at the desired lower resolution.

The user can manipulate a printer driver or the like to set his/her desired resolution, based on which the printer will perform its printing operation onto the corresponding kind of paper set in the printer.

The user will, however, possibly designate a high resolution even when the printer is set with a paper of a low ink permeability. The user will also possibly designate a low resolution when the printer is set with a paper of a high ink permeability. In these cases, the printer will fail to provide the user's desired resolution images.

Generally, the user may not easily judge the characteristic of a recording paper. Accordingly, in order to obtain the user's desired quality image, the user will have to perform printing trials many times on papers now set in the printer, while changing the resolution value, in order to find out a resolution value appropriate for the presently-set recording papers. Many recording papers and a large amount of ink will be wasted.

It is therefore, an object of the present invention to overcome the above-described drawbacks, and to provide an improved image printing device which can provide high quality images onto any kinds of recording papers and which can save time, paper, and ink.

In order to attain these and other objects, the present invention provides an imager printing device for printing an image on a recording medium, the device comprising: input means for receiving image information; judging means for judging a characteristic of a recording medium to be printed with the image information; resolution setting means for setting, based on the judged result, a resolution at which the image information is to be printed on the recording medium; and print means for printing the image information on the recording medium at the set resolution.

The image printing device may further comprise: storage means for storing information on a characteristic judgeable by the judging means; and correction means for correcting the information on the characteristic stored in the storage means.

BRIEF DESCRIPTION OF THE DRAWINGS

The above and other objects, features and advantages of the invention will become more apparent from reading the following description of the preferred embodiment taken in connection with the accompanying drawings in which:

FIG. 1(*b*) illustrates ink dots printed at a resolution of 600 dpi;

FIG. 2(*b*) illustrates how ink spreads on a recording paper when the recording paper has a high ink permeability;

FIG. 3(*b*) illustrates a paper characteristic table T stored in a paper characteristic memory 14*a* provided to the ink jet printer 1;

FIG. 9(*b*) shows how the position of a separation guide plate is changed according to the second embodiment.

DETAILED DESCRIPTION OF THE PREFERRED EMBODIMENTS

Figure 1:
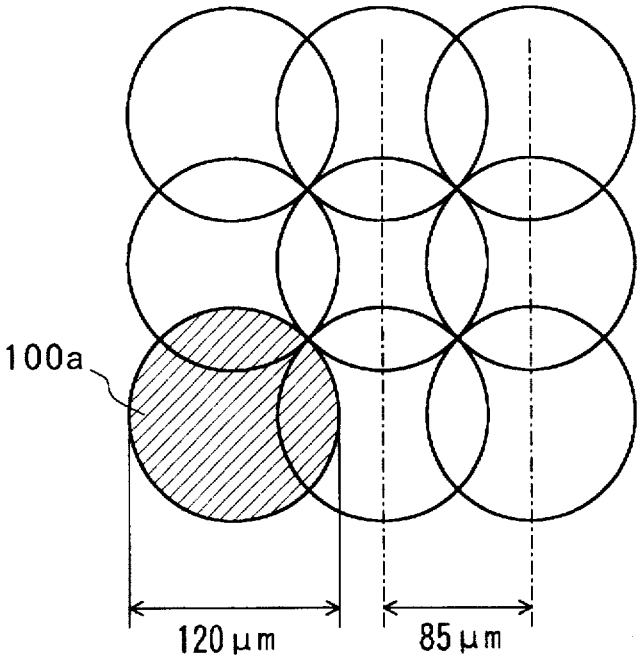
FIG. 1(*a*) illustrates ink dots printed at a resolution of 300 dpi.
Figure 1:
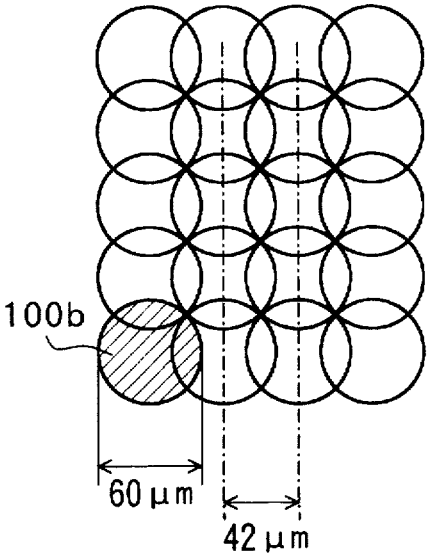
Figure 2:
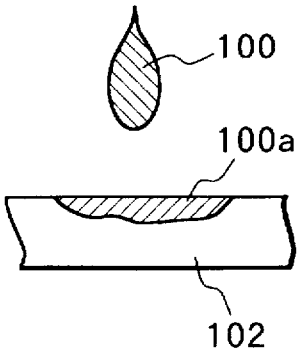
FIG. 2(*a*) illustrates how ink spreads on a recording paper when the recording paper has a low ink permeability.
Figure 2:
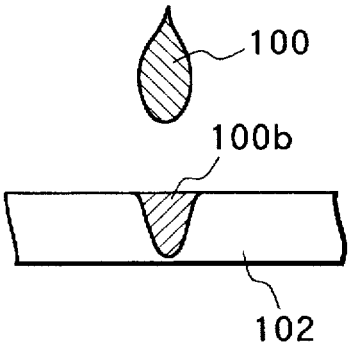

An image printing device according to preferred embodiments of the present invention will be described while referring to the accompanying drawings wherein like parts and components are designated by the same reference numerals to avoid duplicating description.

A first embodiment of the present invention will be described below with reference to FIGS. 3(*a*) through 6.

Figure 3:
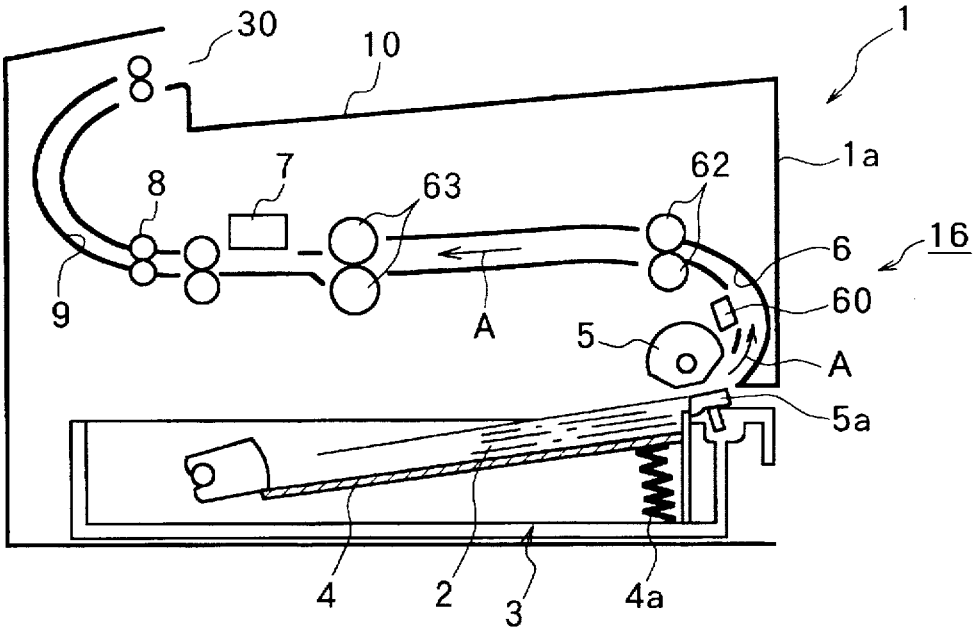
FIG. 3(*a*) is a schematic sectional view of an ink jet printer 1 according to a first embodiment of the present invention.

FIG. 3(*a*) is a schematic sectional view of an ink jet printer 1 according to the first embodiment.

The printer 1 is enclosed in a body casing 1*a*. A sheet cassette 3 is detachably mounted on a bottom surface of the body casing 1*a*. The sheet cassette 3 is provided with a sheet reception board 4 for receiving thereon a stack of a plurality of recording sheets 2. Each recording sheet 2 is cut into a predetermined size appropriate for being recorded with the printer 1. A sheet feed roller 5, of a substantially half-cylindrical shape, is rotatably provided inside the body casing 1*a*. A spring 4*a* is provided in the sheet cassette 3 for urging the stack of sheets 2 upwardly against the sheet feed roller 5. A friction pad 5*a* is located in confrontation with the sheet feed roller 5.

The sheet feed roller 5 serves to pick up the sheets 2 one by one from the sheet cassette 3. The sheet feed roller 5 and the friction pad 5*a* operate in combination to feed the picked-up sheet 2 along a sheet transport path 6 in a direction Indicated by an arrow A. A first pair of drive rollers 62 and a second pair of drive rollers 63 are arranged along the sheet transport path 6 for further transporting the sheet 2 in the direction A.

An ink jet recording head 7 is provided in a downstream side of the second pair of drive rollers 63. The ink jet recording head 7 is for ejecting ink on the sheet 2 when the sheet 2 passes by the ink jet recording head 7. The ink jet recording head 7 is movable in a main scanning direction (sheet widthwise direction) which is perpendicular to the sheet feed direction A. In this example, the main scanning direction is defined normal to the sheet of drawing.

A pair of image fixing rollers 8 are provided in a downstream side of the ink jet recording head 7. The image fixing rollers 8 are for fixing the ink onto the sheet 2. A discharge path 9 is provided in a downstream side of the image fixing rollers 8 for transporting the image-fixed sheet 2 toward a discharging outlet 30, from which the sheet 2 is discharged out onto a discharge sheet tray 10.

With the above-described structure, the recording sheets 2 are picked up one by one by the sheet feed roller 5. Thus picked up sheet 2 is held between the sheet feed roller 5 and the friction pad 5*a* and fed to the sheet transport path 6. The sheet 2 is fed in the direction A as the sheet feed roller 5 rotates. The recording sheet 2 is further conveyed by the drive rollers 62 and 63 along the sheet transport path 6. When the recording paper 2 passes by the ink jet recording head 7, the recording paper 2 is printed with ink dots ejected from the print head 7. The sheet 2 then passes between the pair of image fixing rollers 8 where the ink dots are fixed to the paper 2. The paper 2 is then transported along the discharge path 9 and discharged out of the casing 1*a*. The discharged paper 2 is received on the discharge sheet tray 10.

According to the present embodiment, a paper characteristic detector 16 is provided in the sheet transport path 6. In this example, the paper characteristic detector 16 is comprised of a photosensor 60 located at a position between the feed roller 5 and the first drive rollers 62. The photosensor 60 is for measuring a light reflectance of the recording paper 2. Although not shown in the drawing, the photosensor 60 is comprised of a combination of a light source and a light detecting unit. When the printer 1 starts printing, the sheet feed roller 5 starts rotating to pick up one recording sheet 2 out of the cassette 3 as described above. The sheet feed roller 5 then feeds the sheet 2 into the transport path 6. At this moment, the light source in the photosensor 60 is turned ON to irradiate the recording paper 2 with light. The light reflects off the paper 2. The amount of light reflected from the paper 2 is dependent on the light reflectance of the paper 2. The light reflected from the paper 2 is therefore detected by the light detecting unit, which in turn outputs a signal indicative of the detected light amount. The signal therefore indicates the light reflectance of the paper 2. In this example, the light detecting unit in the photosensor 60 can output data of a light amount in a range of 0 to 255. When the paper 2 has a high light reflectance, the photosensor 60 outputs data of a high light amount.

Figure 4:
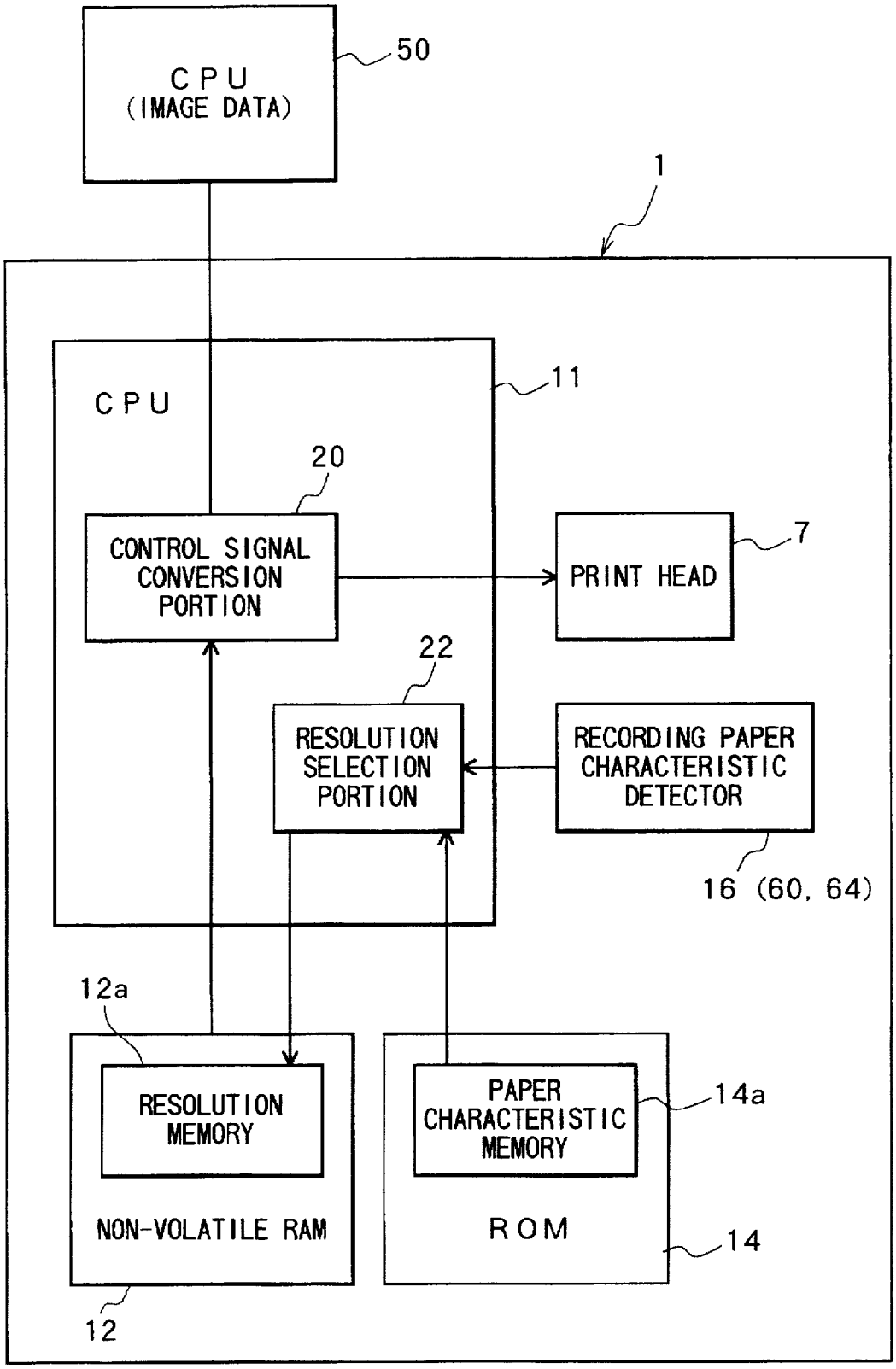
FIG. 4 is a functional block diagram of a control portion of the printer 1 of the first embodiment.

FIG. 4 is a functional block diagram of a control portion provided in the printer 1. The printer 1 is electrically connected to a central processing unit (CPU) 50 in an external device such as a personal computer. Data can be transferred between the printer 1 and the CPU 50 of the external device.

The control portion of the printer 1 includes a CPU 11 which serves as an input portion for receiving data transferred from the external CPU 50. A non-volatile RAM 12, a ROM 14, the paper characteristic detector 16 (photosensor 60), and the print head 7 are connected to the CPU 11

The CPU 11 includes a control signal conversion portion 20 and a resolution selection portion 22. The non-volatile RAM 12 is formed with a resolution memory 12*a*. The ROM 14 is formed with a paper characteristic memory 14*a*.

The paper characteristic memory. 14*a* previously stores therein a paper characteristic table T as shown in FIG. 3(*b*). The paper characteristic table T lists all the light amount values outputtable from the photosensor 60. In this case, because the photosensor 60 can output light amount detection signals in the range of 0 to 255, the paper characteristic table T lists values of 0 to 255 as paper characteristic values. Thus, the paper characteristic table T stores characteristics of all the kinds of papers detectable by the photosensor 60. The paper characteristic table T also stores resolution values most appropriate for the respective paper characteristics. That is, the paper characteristic table T stores a resolution value most appropriate for a kind of paper which presents a light reflectance indicated by each light amount value. In the paper characteristic table T, therefore, a resolution value, most appropriate for each kind of paper 2, is stored at an address indicated by a light amount value which will be outputted by the photosensor 60 when the photosensor 60 detects that kind of paper 2.

As apparent from FIG. 3(*b*), in this example, the paper characteristic table T is created so that the resolution value increases as the light amount value increases. This is because when the paper 2 presents a high light reflectance, the paper 2 generally has a smooth surface and therefore has a high ink permeability. Ink dots will have a small diameter. Accordingly, the paper 2 is appropriate for producing images at a high resolution. On the other hand, when the paper 2 presents a low light reflectance, the paper 2 generally has a rough surface and therefore has a low ink permeability. Ink dots will have a large diameter. Accordingly, the paper 2 is appropriate for producing images at a low resolution. In this example, a resolution value of 300 dpi is stored in correspondence with each of the light amount values in the range of 0 to (H−1) where the threshold value H (not shown) is an integer higher than 0 and lower than 255. Another resolution value of 600 dpi is stored in correspondence with each of the light amount values in the range of H to 255.

The resolution selection portion 22 is for receiving an actual detection signal outputted from the photosensor 60. The actual detection signal indicates a light amount detected by the photosensor 60 when a paper 2 actually passes by the photosensor 60. The resolution selection portion 22 selects a resolution value which is stored in the paper characteristic table T in correspondence with the light amount value indicated by the actual detection signal. The resolution selection portion 22 then sets the selected resolution value in the resolution data memory 12*a*. In this example, when the photosensor 60 outputs a light amount value in the range of 0 to (H−1), the resolution selection portion 22 selects a resolution value of 300 dpi and sets this value in the memory 12*a*. On the other hand, when the photosensor 60 outputs a light amount value in the range of H to 255, the resolution selection portion 22 selects a resolution value of 600 dpi and sets this value in the memory 12*a*.

It is noted that when the photosensor 60 next detects another kind of paper, the resolution selection portion 22 selects another resolution value. The resolution selection portion 22 changes the resolution value, stored latest in the memory 12*a*, into the newly-selected resolution value.

The control signal conversion portion 20 is for receiving image data 52 transferred from the external CPU 50 and for retrieving presently-stored resolution data from the resolution memory 12*a*. The control signal conversion portion 20 converts the received image data 52 into a control signal based on the retrieved resolution data. The control signal conversion portion 20 outputs the control signal both to the print head 7 and to the drive rollers 62 and 63. The print head 7 and the drive rollers 62 and 63 will be controlled by the control signal to print the image data 52 at a resolution indicated by the resolution data.

In more concrete terms, the control data includes: data of an ejection time interval at which the print head 7 is to be driven to eject ink; and data of a feed speed with which the drive rollers 62 and 63 are to be driven to feed the sheet 2 in the sheet feed direction A. It is noted that the print head 7 is moved in the main scanning direction at a predetermined scanning speed. The ejection time interval therefore determines an interval or a distance at which ink dots are arranged on the recording paper 2 in the main scanning direction (sheet width direction). The feed speed data determines another interval at which ink dots are arranged on the recording paper 2 in the sheet feeding direction A.

With the above-described structure, the printer 1 prints images as described below.

When the user manipulates the external device to instruct his/her desired printing operation, the CPU 50 in the external device transfers a print start signal to the CPU 11. Upon receiving the print start signal, the CPU 11 instructs the sheet feed roller 5 to pick-up the uppermost sheet 2 from the sheet cassette 3 and to feed the sheet 2 to the sheet transport path 6. As a result, the light source in the photosensor 60 irradiates the sheet 2 with light, and the light detecting unit detects the amount of light reflected from the sheet 2. The photosensor 60 outputs the light amount detection signal to the resolution selection portion 22 in the CPU 11.

The resolution selection portion 22 then selects one resolution value that is stored in the paper characteristic table T at an address of a light amount indicated by the received light amount detection signal. Thus, the resolution selection portion 22 can select a resolution degree most appropriate for the recording paper 2 now transported toward the printing head 7. The resolution selection portion 22 writes the selected resolution data to the resolution data memory 12*a*.

When the selection of the resolution degree is thus completed, the CPU 11 starts receiving image data 52 which is now transferred from the CPU 50. The control signal conversion portion 20 retrieves the resolution data now stored in the resolution data memory 12*a*. Based on the resolution data, the control signal conversion portion 20 converts the image data 52 into a control signal. The control signal will control the print head 7 and the drive rollers 62 and 63 to print images represented by the image data 52 at a resolution indicated by the resolution data.

The print head 7 receives the control signal outputted from the control signal conversion portion 20. The print head 7 is driven with the control signal to print images onto the recording paper 2 when the paper 2 passes by the print head 7. The print head 7 is moved in the main scanning direction at the predetermined scanning speed. When the resolution data supplied from the resolution data memory 12*a* indicates a high resolution, the control signal conversion portion 20 produces the control signal so that the control signal will control the print head 7 to eject ink at a short time interval. Ink dots will be arranged on the recording paper 2 with a small interval in the main scanning direction. The control signal will also control the drive rollers 62 and 63 to feed the paper 2 at a low feed speed. Ink dots will therefore be arranged on the recording paper 2 with a small interval also in the sheet feeding direction A.

On the other hand, when the resolution data supplied from the resolution data memory 12*a* indicates a lower resolution, the control signal conversion portion 20 produces the control signal so that the control signal will control the print head 7 to eject ink at a longer time interval. Accordingly, ink dots will be arranged on the recording paper 2 with a larger interval in the main scanning direction. The control signal will also control the drive rollers 62 and 63 to feed the paper 2 at a higher feed speed. Ink dots will therefore be arranged on the recording paper 2 with a larger interval also in the sheet feeding direction A.

As described above, the print head 7 is designed to eject ink onto a recording sheet with a plurality of resolution degrees. A plurality of kinds of recording papers have different degrees of ink permeability. Ink dots of different diameters can therefore be printed on different kinds of papers. According to the present embodiment, the characteristic of the recording paper is detected, and the resolution, at which the print head 7 is to be controlled to print images on the recording paper, is selected dependent on the detected result. The printer 1 can therefore reproduce a high quality image onto any kind of papers and is good in its economical view. The CPU 11 receives image data from the external CPU 50. The resolution data memory 12*a* stores a resolution value which is appropriate for the paper characteristic detected by the paper characteristic detector 16. The control signal conversion portion 20 converts the image data into a control signal for controlling the print head 7 to print the image data onto the recording medium at the resolution stored in the memory 12*a*.

A modification of the first embodiment of the present invention will be described below with reference to FIG. 5.

In the above description, the paper characteristic detector 16 is comprised of the photosensor 60 for detecting the light reflectance of the paper 2. Contrarily, in the present modification, the paper characteristic detector 16 is constructed to measure a tenacity of the paper 2. The paper characteristic detector 16 is comprised of a separation guide plate 61 disposed in the sheet transport path 6 at a position between the first pair of drive rollers 62 and the second pair of drive rollers 63. The separation guide plate 61 is for dividing the sheet transport path 6 into an upper path 6*a* and a lower path 6*b*. A switch 64 is disposed in the upper path 6*a*.

If the recording paper 2 has a high tenacity, a leading end of the paper 2 does not bend downwardly when the paper 2 emerges from between the first pair of drive rollers 62. The paper 2 will then travel in the upper path 6*a* and close the switch 64. The switch 64 outputs an ON signal indicative of a detection of the paper 2.

On the other hand, if the recording paper 2 has a lower tenacity, a leading end of the paper 2 bends downwardly when the paper 2 emerges from between the first pair of drive rollers 62. The paper 2 will then travel in the lower path 6*b*. The switch 64 will maintain opened and will continue outputting an OFF signal. The OFF signal, is indicative of detection of no paper.

Thus, the combination of the switch 64 and the separation guide plate 61 construct the paper characteristic detector 16 for determining the tenacity of the paper 2. When the paper 2 is detected to present a high tenacity, it can be judged that the paper 2 has a large thickness and therefore has a high ink permeability. When the paper 2 is detected to present a low tenacity, it can be judged that the paper 2 has a small thickness and therefore has a low ink permeability.

According to the modification, the memory 14*a* has a paper characteristic table T' instead of the table T shown in FIG. 3(*b*). The paper characteristic table T' lists a high resolution value (600 dpi, for example) in correspondence with ON data, and a low resolution value (300 dpi, for example) in correspondence with OFF data.

When printing is instructed and the sheet of paper 2 starts being transported along the transport path 6, the resolution selection portion 22 judges whether or not the signal outputted from the switch 64 changes from OFF to ON within a predetermined period of time. The predetermined time period corresponds to a time length required by the sheet 2 to travel from the cassette 3 to the separation guide plate 61. If the signal from the switch 64 changes from OFF to ON within the predetermined time period, the resolution selection portion 22 retrieves the high resolution value (600 dpi, in this example) from the memory 14*a*. On the other hand, if the signal from the switch 64 does not change, the resolution selection portion 22 retrieves the low resolution value (300 dpi, in this example) from the memory 14*a*. The resolution selection portion 22 stores the selected resolution value in the memory 12*a*. When the selection of the resolution degree is thus completed, the CPU 11 starts receiving image data 52 from the CPU 50. The control signal conversion portion 20 then produces the control signal for printing the image data 52 with the resolution stored in the memory 12*a*. When the paper 2 passes by the print head 7, the print head 7 and the drive rollers 62 and 63 are controlled by the control signal to print images on the paper 2 at the stored resolution which is most appropriate for the paper 2.

It is noted that the paper characteristic detector 16 may not be constructed to detect light reflectance or tenacity of the paper 2. The paper characteristic detector 16 may be constructed to detect other various characteristics of the paper 2. For example, the paper characteristic detector 16 may be constructed to detect still another parameter of the paper, such as light transmittance, weight, water content, permittivity, friction coefficient, surface roughness, or the like of the paper. The paper characteristic detector 16 can determine the difference, in the parameter, between sheets with high ink-permeability and sheets with low ink-permeability. In other words, the detector 16 can discriminate between sheets with high ink-permeability and sheets with low ink-permeability.

The memory 14*a* may store a paper characteristic table where a plurality of resolution values are listed in correspondence with a plurality of parameter values detectable by the detector 16. When one sheet 2 passes by the detector 16, the detector 16 measures the parameter of the sheet 2. The resolution selection portion 22 selects one resolution value which is stored in the memory 14*a* in correspondence with the measured parameter value. The resolution selection portion 22 sets the selected resolution value in the memory 12*a*. The control signal conversion portion 20 will produce a control signal from the image data 52 based on the resolution value thus stored in the memory 12*a*.

Figure 6:
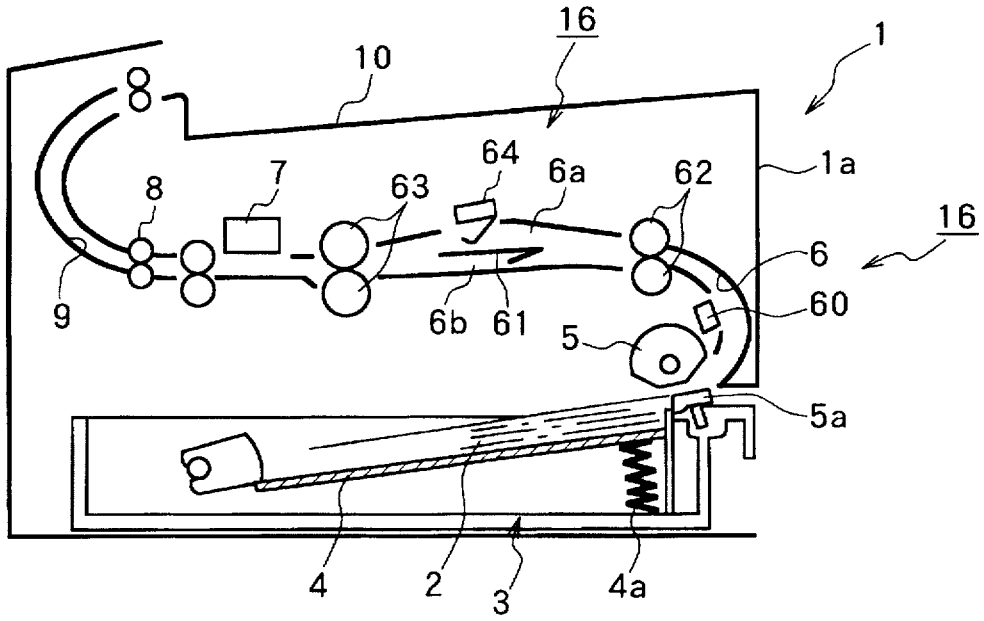
FIG. 6 is a schematic sectional view of an ink jet printer 1 according to another modification of the first embodiment.

The paper characteristic detector 16 may be constructed from several detectors for detecting two or more of the above-listed features. It may be possible to control those several detectors to simultaneously perform their detections, thereby determining the characteristic (ink permeability) of the paper 2 based on all the detected results. For example, as shown in FIG. 6, the photosensor 60, the switch 64, and the separation guide plate 61 may be provided in the printer 1. In this example, the abovedescribed tables T and T' are combined into another table and stored in the memory 14*a*. A resolution value appropriate for a presently-used paper can be selected from the table based on the signals outputted from both the photosensor 60 and the switch 64.

Alternatively, the paper 2 may be originally printed with a mark especially used for indicating a kind of the paper 2. The mark may be constructed from a bar code or other invisible marks. In this case, the paper characteristic memory 14*a* may be formed with still another table which stores a plurality of resolution values in correspondence with a plurality of marks printed on all the kinds of papers. The mark on the paper 2 is detected by the paper characteristic information detector 16. A resolution value appropriate for the presently-used paper is selected from the table based on the detected result.

As described above, according to the present embodiment, the characteristic of the paper 2 is detected by the paper characteristic detector 16. Because the ink dot diameter is determined dependent on the characteristic of the paper 2, the control signal conversion portion 20 produces a control signal indicative of a resolution the most appropriate for the ink dot diameter. The paper will therefore be printed with a high quality image. Because the above-described operation is automatically performed, the user will not need to consider the characteristic of the paper 2 before printing. The user will easily obtain a high quality image.

Additionally, the printer 1 will not erroneously produce a control signal for printing high resolution images when the printer is set with a paper appropriate for low resolution images. The printer 1 will not erroneously produce a control signal for printing low resolution images when the printer is set with a paper appropriate for high resolution images. It becomes possible to shorten the total length of time required for the entire printing operation. The printer will therefore not erroneously print images with resolution inappropriate for the papers. The printer can therefore save ink, and is therefore highly economical.

Figure 7:
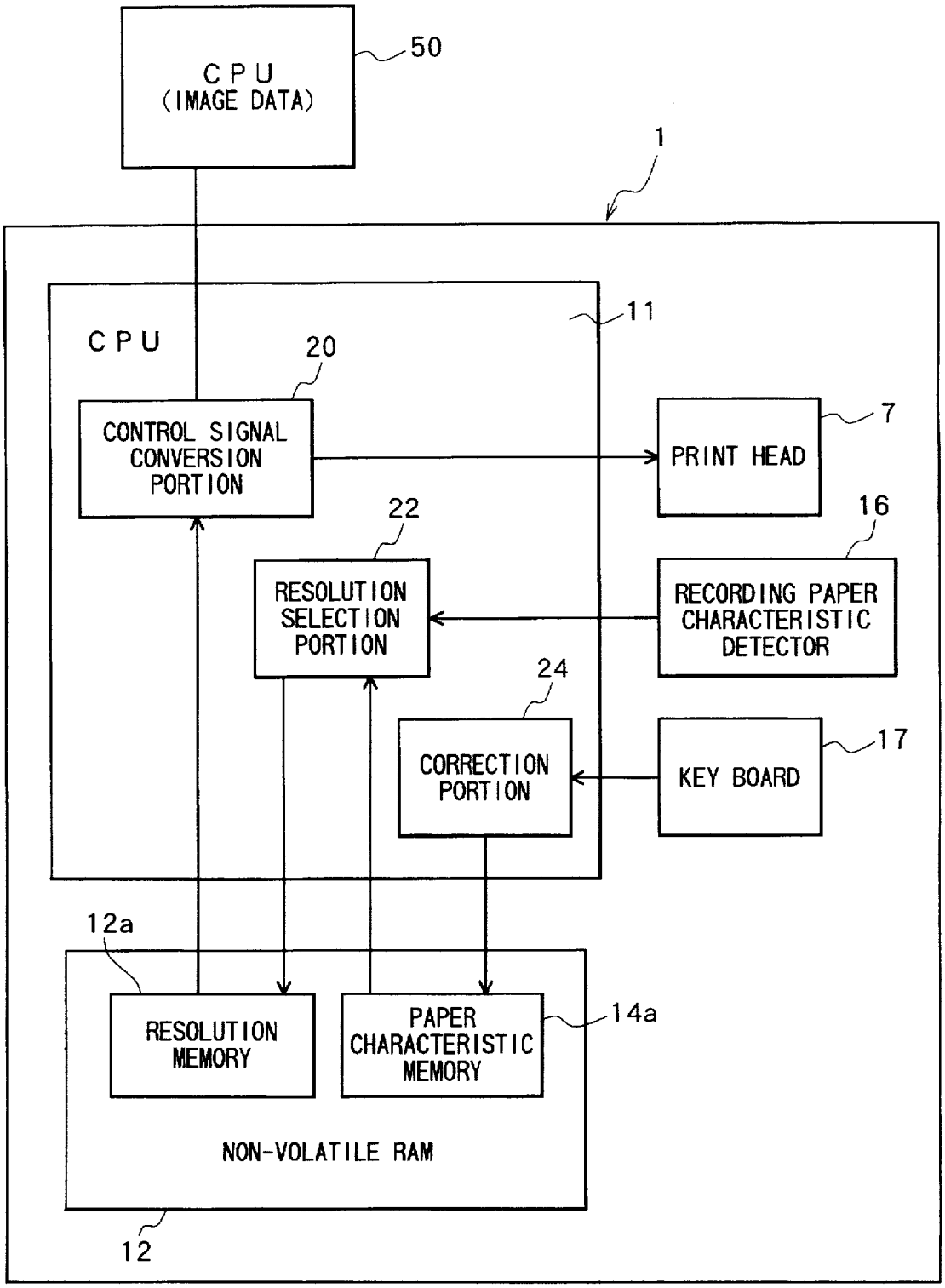
FIG. 7 is a functional block diagram of a control portion of the printer 1 according to a second embodiment of the present invention.
Figure 8:
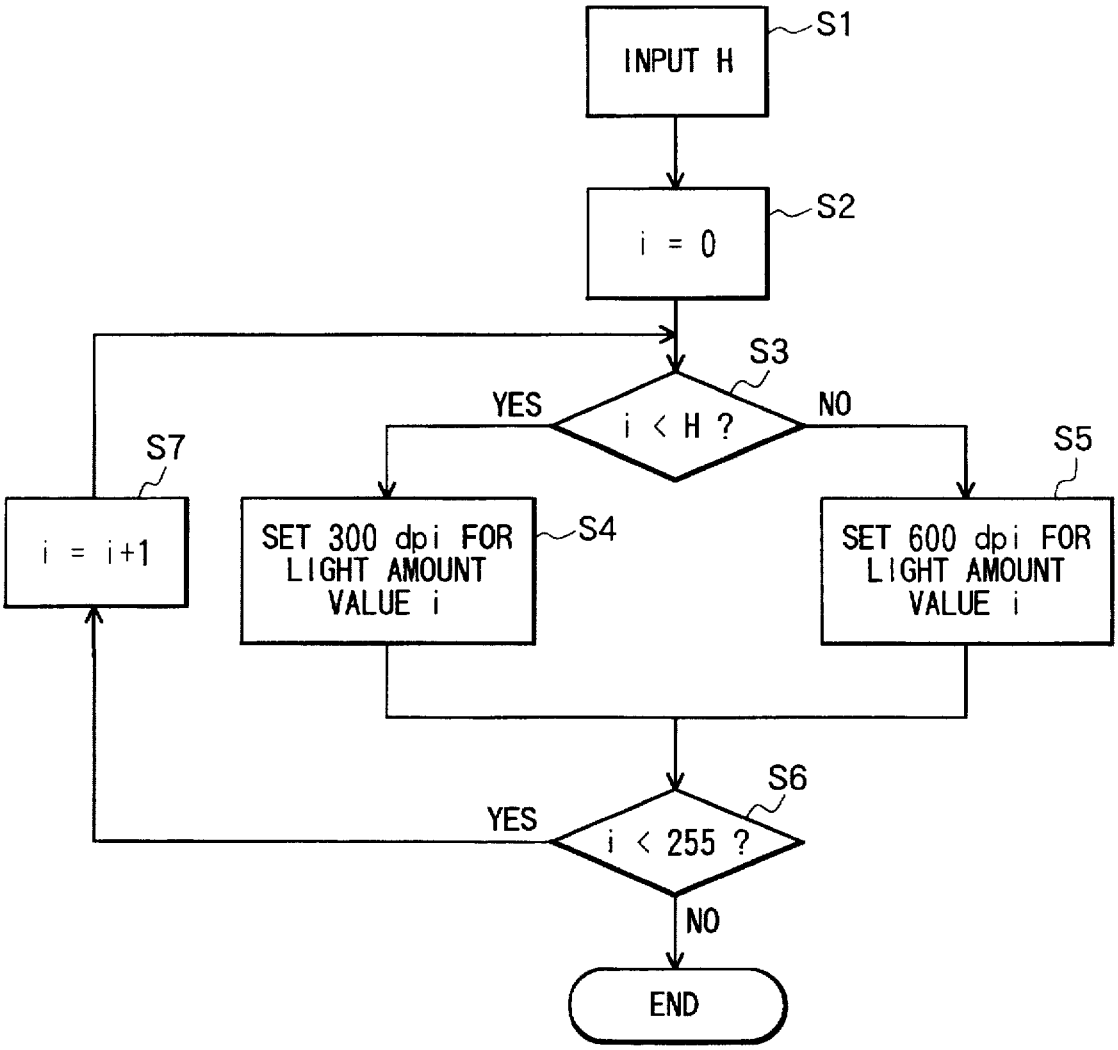
FIG. 8 is a flow chart of a correction operation performed in the second embodiment.
Figure 9:
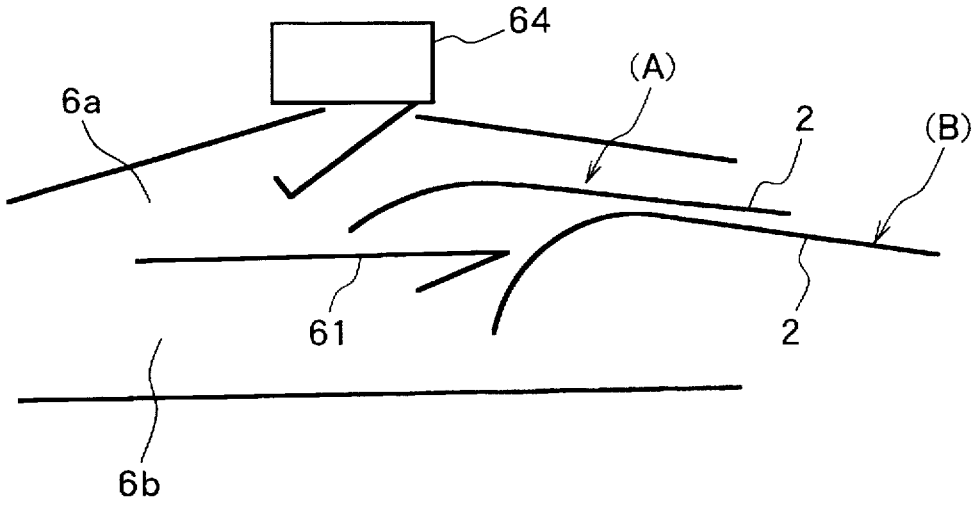
FIG. 9(*a*) shows how a certain kind of paper bends according to the ambient humidity.
Figure 9:
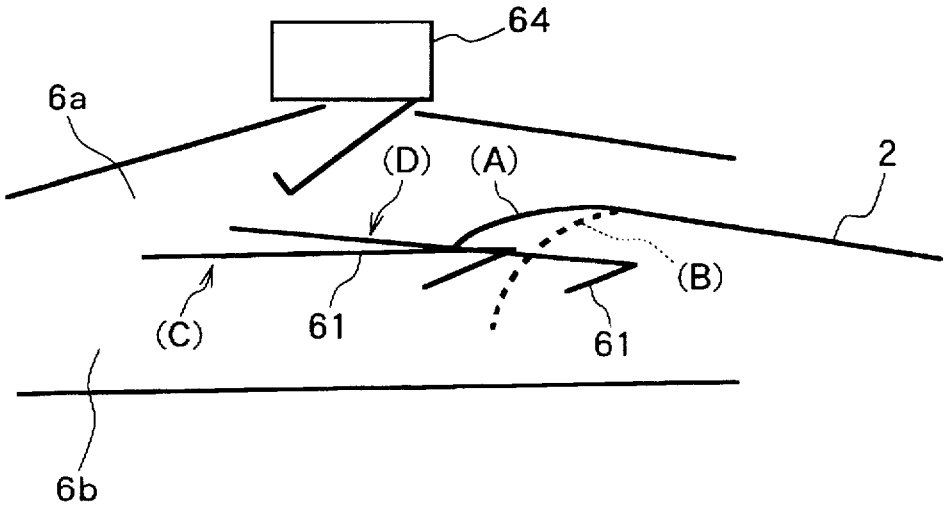

A second embodiment of the present invention will be described below with reference to FIGS. 7 through 9(*b*).

The structure of an ink jet printer 1 of the second embodiment is substantially the same as that of the first embodiment except for the following points.

The printer 1 of the present embodiment is additionally provided with a key board 17. The CPU 11 is provided with not only the control signal conversion portion 20 and the resolution selection portion 22 but also a correction portion 24. The non-volatile RAM 12 is formed with not only the resolution memory 12*a* but also the paper characteristic memory 14*a*. Because the memory 14*a* is provided in the non-volatile RAM 12, data in the memory 14*a* can be rewritten. The correction portion 24 is inputtable with data from the key board 17. The correction portion 24 is for changing the paper characteristic values stored in the paper characteristic memory 14*a*. For example, when the paper characteristic detector 16 is comprised of the photosensor 60 as shown in FIG. 3(*a*), the correction portion 24 can change the relationship between the light amount values and the resolution values stored in the memory 14*a* (shown in FIG. 3(*b*)).

The present embodiment is achieved taking into consideration that the sensitivity of the paper characteristic detector 16 (photosensor 60, in this example) will possibly vary in time and due to changes in the ambient temperature and humidity. The characteristics of the respective papers will possibly change according to the ambient temperature and humidity. In this case, the paper characteristic values (light amount values, in this example) stored in the memory 14*a* will fail to properly match the light amount values actually obtainable by the detector 16 (photosensor 60). According to the present embodiment, therefore, when the detector sensitivity and/or the paper characteristic changes, the user can manipulate the key board 17 to compensate for this change, thereby providing a more stable detection of the paper 2.

In more concrete terms, the key board 17 includes a paper characteristic correction key (not shown). When the user depresses the paper characteristic correction key, the printer 1 is brought into a correction mode. The correction portion 24 waits for a subsequent input from the key board 17. The user then manipulates the key board 17 to input correction data for correcting the paper characteristic information. Based on the received correction data, the correction portion 24 corrects the paper characteristic values (light amount values, in this example), the resolution values, or both stored in the memory 14*a*, into those that properly indicate the present condition of the detector 16 and the present paper characteristics. Or otherwise, the correction portion 24 may correct the detection condition of the detector 16.

For example, when the sensitivity of the photosensor 60 varies in time, the user may perform a correction operation as described below.

The user first depresses the paper characteristic correction key. As a result, the printer 1 is brought into a correction mode, and the correction operation shown in FIG. 8 starts. During the correction operation, the user first manipulates in S1 the key board 17 to input a new threshold value H ($0<H<255$) which is appropriate for the present condition of the photosensor 60. In S2, the correction portion 24 initializes a variable (i), indicative of a light amount value, to a zero (0) value. When the variable (i) is lower than the newly-set threshold H (yes in S3), a resolution value of 300 dpi is written in the table T (memory 14*a*) in correspondence with the light amount value (i) in S4. On the other hand, when the variable (i) is equal to or higher than the newly-set threshold H (no in S3), a higher resolution value of 600 dpi is written in the table T in correspondence with the light amount value (i) in S5. While the variable (i) is lower than 255 (yes in S6), the program proceeds to S7 where the variable (i) is incremented by one (1). Then, the program returns to S3. When the variable (i) reaches 255 (no in S6), the program ends.

When the correction operation is thus completed, the table T is renewed. That is, the table T lists resolution values in correspondence with all the light amount values 0 to 255 which are outputtable from the photosensor 60 under the present condition. The resolution values are appropriate for the corresponding light amount values. Thus, according to the correction operation, the user can correct the relationship between the light amount values (0 to 255) and the resolution values (300 and 600 dpi) into that appropriate for the present condition of the photosensor 60. Because the above-described correction operation thus compensates for the change in sensitivity of the photosensor 60, the photosensor 60 can continue its stable detection.

The user can thus freely change the relationship between the characteristics of the recording papers and the resolution degrees listed in the paper characteristic memory 14*a*. Accordingly, the user can control the printer 1 to always provide images at his/her desired image quality.

Similarly as in the first embodiment, when the printing is started and the sheet of paper 2 is picked up and conveyed along the sheet transport pith 6, the resolution selection portion 22 receives the actual detection signal from the paper characteristic detector 16 (photosensor 60). The resolution selection portion 22 then selects a resolution value that is now stored in the paper characteristic memory 14*a* in correspondence with a light amount value indicated by the received actual detection signal. The resolution selection portion 22 writes the selected resolution value in the resolution memory 12*a*. Then, the CPU 11 starts receiving image data 52 transmitted from the external CPU 50. The control signal conversion portion 20 retrieves, from the resolution memory 12*a*, the resolution data which indicates a resolution degree most appropriate for the presently-transported paper 2. The control signal conversion portion 20 converts the Image data 52 into a control signal that will control the print head 7 to print images on the paper 2 with the determined resolution degree.

Figure 5:
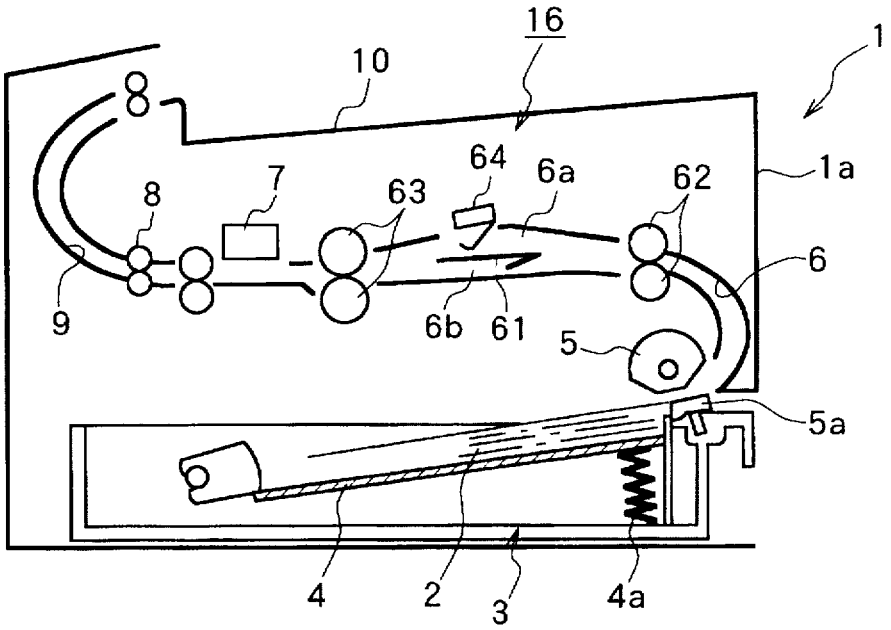
FIG. 5 is a schematic sectional view of an ink jet printer 1 according to a modification of the first embodiment.

It is noted that the second embodiment can also be constructed as shown in FIG. 5 so that the paper characteristic detector 16 be comprised of the switch 64 and the separation guide plate 61 for detecting tenacity of the paper 2. When the tenacity of the paper 2 changes due to ambient humidity or the like, the paper bending manner changes. For example, even though a certain kind of paper 2 normally bends in a manner (A) as shown in FIG. 9(*a*), the paper 2 will possibly bend in another manner (B) due to the change in the ambient humidity. Though the paper 2 normally travels along the upper path 6*a* and turns ON the switch 64, the change in the ambient humidity will cause the paper 2 to travel along the lower path 6*b*. The paper 2 will fail to turn ON the switch 64.

In order to compensate for this change in the paper's tenacity, according to the present embodiment, the user manipulates the key board 17 to move the separation guide plate 61 into another position. For example, if the separation guide plate 61 is normally in a position (C) shown in FIG. 9(*b*), the user manipulates the key board 17, whereupon the correction portion 24 moves the separation guide plate 61 into another position (D) which is also shown in the drawing. With the separation guide plate 61 being located in the position (D), even when the paper 2 bends in the manner (B), the paper 2 will certainly travel along the upper path 6*a* and will turn ON the switch 64.

The second embodiment can also be constructed so that the paper characteristic detector 16 be comprised of other various types of detectors described in the first embodiment.

As described above, the image print device of the present invention includes: the input portion for receiving image information; the print portion for performing a printing operation onto a recording medium; and the resolution setting portion for setting a resolution at which the print portion will print the image information on the recording medium. The image print device further includes the recording medium judging portion for judging a characteristic of the recording medium. The resolution setting portion sets the resolution based on the judged results. With this structure, the user will not have to consider the characteristic of the recording medium. The printer will print images on the recording medium at a resolution most appropriate for the characteristic of the recording medium.

There is no possibility that the image print device will erroneously produce print control data inappropriate for the characteristic of the recording medium. There is no possibility that the image print device will erroneously perform printing operation at an inappropriate resolution in vain. The total time length of the printing operation can be shortened. It Is possible to save ink. The image print device is advantageous in its economical view.

Especially when the image print device is provided with the paper characteristic information memory and the characteristic correction portion, it is possible to correct the characteristic information data stored in the memory. With the thus corrected memory, the recording medium judging portion can highly stably judge the characteristic of the recording medium accurately. The user ban freely correct for the relationship between resolution degree and the characteristic of the recording medium.

While the invention has been described in detail with reference to the specific embodiments thereof, it would be apparent to those skilled in the art that various changes and modifications may be made therein without departing from the spirit of the invention.

For example, in the above-described embodiments, the control signal will change the time interval at which the print head 7 ejects ink droplets. However, the control signal may not change the ejection time interval. Alternatively, the control signal may change the head scanning speed at which the print head 7 is scanned in the main scanning direction. When the resolution data supplied from the resolution data memory 12*a* indicates a high resolution, the control signal conversion portion 20 produces the control signal so that the control signal will control the print head 7 to move at a low speed in the main scanning direction. Contrarily, when the resolution data indicates a lower resolution, the control signal conversion portion 20 produces the control signal so that the control signal will control the print head 7 to move at a higher speed in the main scanning direction.

As described above, in the image printing device of the present invention, the input portion receives image information. The judging portion judges a characteristic of a recording medium to be printed with the image information. Based on the judged results, the resolution setting portion sets a resolution, at which the image information is to be printed on the recording medium. The print portion prints the image information on the recording medium at the set resolution. The storage portion stores information on a characteristic of the recording medium to be judged by the judging portion. The correction portion can correct the information on the characteristic.

What is claimed is:

1. An image printing device for printing an image on a recording medium, the device comprising:

input means for receiving image information;

judging means for judging a characteristic of a recording medium to be printed with the image information to generate a judged result indicative of the characteristic;

resolution setting means for setting, based on the judged result, a resolution at which the information is to be printed on the recording medium; and print means for printing the image information on the recording medium at the set resolution.

2. An image printing device as claimed in claim 1, further comprising:

storage means for storing information on a characteristic judgeable by the judging means; and correction means for correcting the information on the characteristic stored in the storage means.

3. An image printing device as claimed in claim 1, wherein the judging means includes detection means for detecting a characteristic of the recording medium to be printed with the image information and for outputting a detection signal indicative of a characteristic value of the recording medium.

4. An image printing device as claimed in claim 3, wherein the storage means stores a plurality of resolution values in correspondence with a plurality of characteristic values outputtable by the detection means, and wherein the judging means includes selection means for selecting one of the plurality of resolution values in accordance with the characteristic value outputted from the detection means.

5. An image printing device as claimed in claim 4, further comprising correction means for correcting at least one of the plurality of characteristic values stored in the storage means.

6. An image printing device as claimed in claim 5, wherein the correction means corrects at least one of the plurality of characteristic values stored in the storage means to compensate for at least one of a change in a detection sensitivity of the detection means and a change in the characteristic of the recording medium.

7. An image printing device as claimed in claim 6, wherein the judging means includes detection means for detecting a light reflectance of the recording medium to be printed with the image information and for outputting a detection signal indicative of the light reflectance value of the recording medium, wherein the storage means stores a plurality of resolution values in correspondence with a plurality of values outputtable by the detection means, and wherein the judging means includes selection means for selecting one of the plurality of resolution values in accordance with the value outputted from the detection means.

8. An image printing device as claimed in claim 7, wherein the plurality of resolution values are stored in the storage means such that the resolution value increases as the value outputtable by the detection means increases.

9. An image printing device as claimed in claim 8, wherein the detection means included a photosensor for irradiating the recording medium with light and for receiving light reflected from the recording medium, the photosensor outputting the detection signal indicative of an amount of light reflected from the recording medium.

10. An image printing device as claimed in claim 1, wherein the print means prints the image information on the recording medium through providing ink on the recording medium, the judging means judges an ink permeability of the recording medium to be printed with the image information, the resolution setting means setting the resolution so that the resolution increases as the detected ink permeability increases.

11. An image printing device as claimed in claim 10, wherein the judging means includes detection means for detecting a tenacity of the recording medium to be printed with the image information and for outputting a detection signal indicative of the tenacity degree of the recording medium, wherein the storage means stores a plurality of resolution values in correspondence with a plurality of tenacity degrees outputtable by the detection means, and wherein the judging means includes selection means for selecting one of the plurality of resolution values in accordance with the detection signal outputted from the detection means.

12. An image printing device as claimed in claim 11, wherein the plurality of resolution values are stored in the storage means such that the resolution value increases as the tenacity degree increases.

13. An image printing device as claimed in claim 1, wherein the print means includes:

a recording medium feeding mechanism for feeding the recording medium in a first direction;

a print head for printing information on the recording medium while moving relative to the recording medium in a second direction different from the first direction; and a control portion for controlling the feeding speed of the recording medium in accordance with the set resolution.

14. An image printing device as claimed in claim 13, wherein the control portion controls the moving speed of the print head in accordance with the set resolution.

15. An image printing device as claimed in claim 13, wherein the print head includes an ink jet recording head for ejecting ink on the recording medium, the control portion controlling the ink ejection time interval in accordance with the set resolution.

* * * * *